US007944890B2

(12) United States Patent
Chen et al.

(10) Patent No.: US 7,944,890 B2
(45) Date of Patent: May 17, 2011

(54) USING WINDOWS SPECIFIED OBJECT IDENTIFIERS (OIDS) FOR AN ANTENNA STEERING ALGORITHM

(75) Inventors: John S. Chen, Downingtown, PA (US); Inhyok Cha, Yardley, PA (US); Richard Simeon, Spring City, PA (US); Daniel P. Steinbach, Yardley, PA (US)

(73) Assignee: InterDigital Technology Corporation, Wilmington, DE (US)

( * ) Notice: Subject to any disclaimer, the term of this patent is extended or adjusted under 35 U.S.C. 154(b) by 1302 days.

(21) Appl. No.: 11/419,836

(22) Filed: May 23, 2006

(65) Prior Publication Data

US 2007/0273589 A1 Nov. 29, 2007

(51) Int. Cl.
*H01Q 1/24* (2006.01)

(52) U.S. Cl. ..... 370/334; 370/345; 370/328; 370/254; 370/329; 370/463; 455/562.1; 455/561; 455/63.4; 343/702; 343/834; 343/700

(58) Field of Classification Search ..... 370/338, 370/254, 463, 329, 328, 345, 453; 455/562.1, 455/561; 709/245, 223; 343/833–834, 702
See application file for complete search history.

(56) References Cited

U.S. PATENT DOCUMENTS 5,519,851 A * 5/1996 Bender et al. ..... 710/301
6,377,218 B1 * 4/2002 Nelson et al. ..... 343/702
6,404,393 B1 * 6/2002 Nelson et al. ..... 343/702
6,629,151 B1 9/2003 Bahl ..... 709/250
6,704,780 B1 3/2004 Sethi ..... 709/223
6,753,826 B2 * 6/2004 Chiang et al. ..... 343/834
6,922,548 B1 7/2005 Moore et al. ..... 455/41.2
7,392,933 B2 * 7/2008 Hepworth et al. ..... 235/375
7,698,550 B2 * 4/2010 Abhishek et al. ..... 713/160
2005/0075142 A1 * 4/2005 Hoffmann et al. ..... 455/562.1
2006/0040707 A1 * 2/2006 Kish et al. ..... 455/562.1
2006/0239209 A1 * 10/2006 Ayyagari et al. ..... 370/254

OTHER PUBLICATIONS

Zhao et al., Distributed MAC Adaptation for WLAN QoS Differentiation, 2003.

* cited by examiner

*Primary Examiner* — Nick Corsaro
*Assistant Examiner* — Michael T Vu
(74) *Attorney, Agent, or Firm* — Allen, Dyer, Doppelt, Milbrath & Gilchrist, P.A.

(57) ABSTRACT

A communications device operates in a wireless local area network (WLAN), and includes a processor operating in accordance with an operating system that includes a standardized set of object identifiers (OIDs) associated therewith. An antenna steering algorithm is executed by the processor for generating a driver query. A driver generates an antenna query in response to the driver query. A smart antenna is driven by the driver and generates antenna beams for receiving signals, and generates metrics based upon the received signals. The smart antenna provides to the driver a metric associated with the antenna query. The driver associates the metric received from the smart antenna with one of the object identifiers from the standardized set of object identifiers, and provides the same to the antenna steering algorithm.

28 Claims, 3 Drawing Sheets

USING WINDOWS SPECIFIED OBJECT IDENTIFIERS (OIDS) FOR AN ANTENNA STEERING ALGORITHM

FIELD OF THE INVENTION

The present invention relates to the field of wireless communications, and more particularly, to an antenna steering algorithm for a client station operating with a smart antenna in an 802.11 wireless local area network (WLAN).

BACKGROUND OF THE INVENTION

Smart antenna technology is directed to antennas having the ability to change radio beam transmission and reception patterns to suit the environment within which radio communication systems operate. Smart antennas have the advantage of providing relatively high radio link gain without adding excessive cost or system complexity.

Smart antenna technology has been used in wireless communication systems for decades, and has recently been investigated for use in wireless local area networks (WLANs). In a WLAN, a client station (CS) is a device used by a mobile end user for communication with other stations within the same WLAN or with other entities outside of the WLAN. Central hubs that provide distribution services in WLANs are referred to as access points (APs). Access points are similar to base stations in wireless telecommunication systems.

A client station can be equipped with a smart antenna as well as an antenna steering algorithm that enables the antenna to switch electronically to a particular directional antenna beam. This enables the client station to communicate with its access point while achieving high performance.

Example client stations are personal computers operating with a wireless network card, such as a PCMCIA (personal computer memory card international association) card, for example. The wireless network card may be compatible with the 802.11 standard, for example, and may include a smart antenna where a number of directional antenna beams are defined as well as an omni-directional antenna beam. The antenna gain of each directional antenna beam is greater than the antenna gain of the omni-directional antenna beam, resulting in an increased range in which a client station can access the network via the access point.

The PCMCIA card requires a driver, which resides in the client station. On one end, the driver provides commands to and/or receives raw data from the PCMCIA card. On the other end, the driver interfaces with an antenna steering algorithm, which, in certain circumstances, resides in the application layer in the client station.

The raw data received by the driver includes information that is to be passed through an application program interface (API) to the antenna steering algorithm in the application layer. As an example, the raw data may include signal-to-noise (S/N) ratios and received signal strength indicators (RSSI) for the signals received by the different directional antenna beams. This data, which may be referred to as object identifiers (OIDs), is then passed to the antenna steering algorithm.

For the antenna steering algorithm to receive the OIDs, customized addresses are assigned at the driver by the PCMCIA card manufacturer. Because of this address customization, translation errors may occur. An example translation error is when the S/N ratios and RSSI values received by the driver are provided to the antenna steering algorithm in a certain order, but the algorithm reads the raw data in a different order. Consequently, the antenna steering algorithm needs to be debugged so that the translation error can be corrected. This is a time consuming and costly approach to correct.

SUMMARY OF THE INVENTION

In view of the foregoing background, it is therefore an object of the present invention to reduce debugging of an antenna steering algorithm being implemented in a client station operating with a smart antenna.

This and other objects, features, and advantages in accordance with the present invention are provided by a communications device for operating in a wireless local area network (WLAN) comprising a processor operating in accordance with an operating system that includes a standardized set of object identifiers associated therewith, and an antenna steering algorithm executed by the processor for generating at least one driver query.

The communications device further comprises a driver for generating at least one antenna query in response to the at least one driver query, and a smart antenna being driven by the driver. The smart antenna generates a plurality of antenna beams for receiving a plurality of signals, and generates metrics based upon the received signals. The smart antenna provides to the driver at least one metric associated with the at least one antenna query.

The driver associates the at least one metric received from the smart antenna with at least one of the object identifiers from the standardized set of object identifiers, and provides the same to the antenna steering algorithm. Since the driver for the smart antenna is using the object identifiers from the standardized set of object identifiers, customized object identifiers do not have to be defined. Instead, the antenna steering algorithm is defined based upon the information provided by the well-known set of object identifiers.

The WLAN may be an 802.11 WLAN, and the operating system may be a Microsoft Windows™ operating system, for example. Consequently, the standardized set of object identifiers may be wireless local area network OID_802_11 object identifiers. The WLAN object identifiers may comprises an OID_802_11_RSSI object identifier, and an OID_802_11_STATISTICS object identifier, for example. The OID_802_11_STATISTICS object identifier may comprise statistics on ACKFailureCount and FCSErrorCount, for example.

The plurality of antenna beams may comprise a plurality of directional antenna beams. The smart antenna may comprise a plurality of antenna elements forming a phased array. Alternatively, the smart antenna may comprise a plurality of antenna elements comprising at least one active antenna element and at least one passive antenna element for forming a switched beam antenna. The smart antenna may be configured as a PCMCIA card.

Another aspect of the present invention is directed to a method for operating a communications device in a WLAN comprising a processor, an antenna steering algorithm, a driver and a smart antenna as defined above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
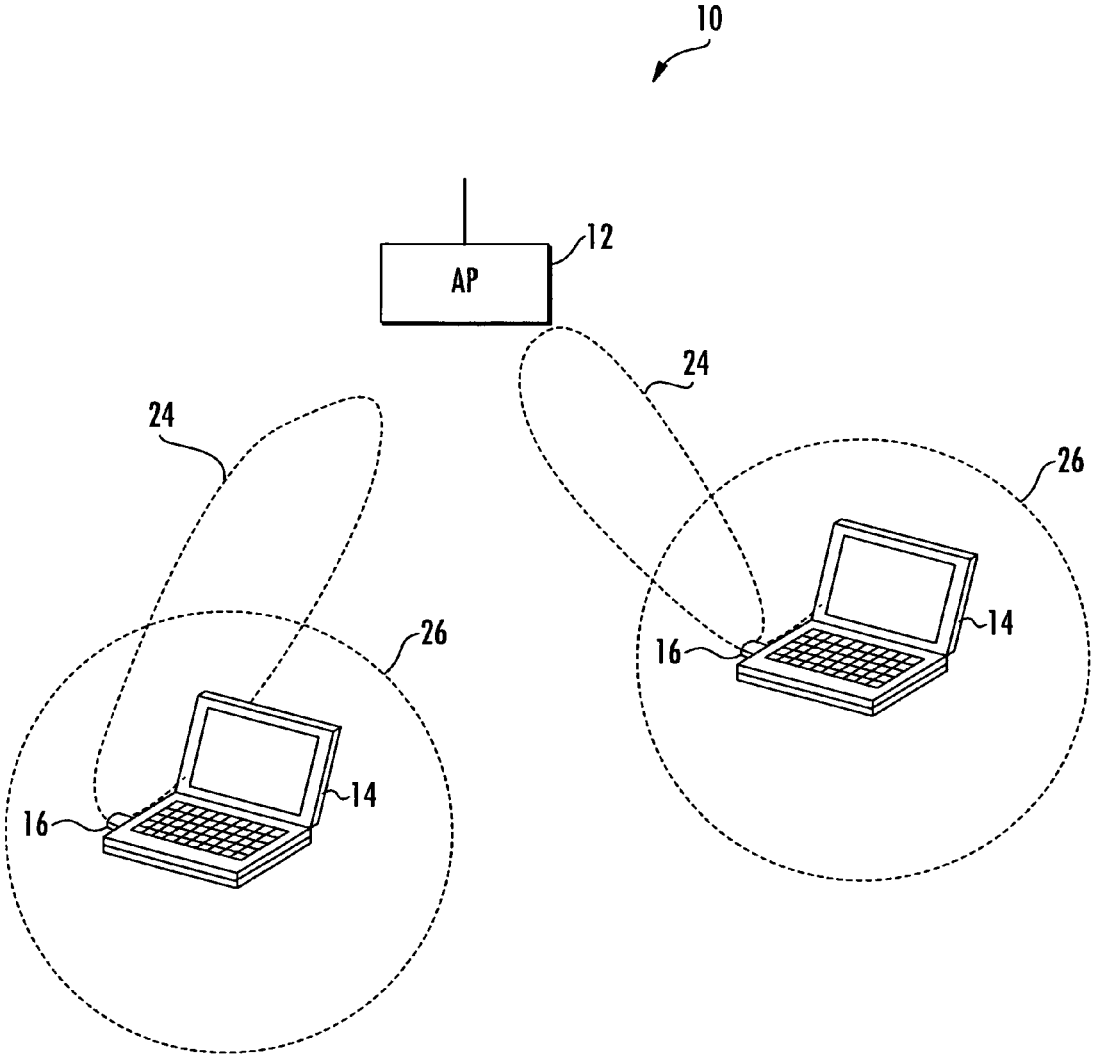
FIG. 1 is a schematic diagram of a wireless local area network (WLAN) illustrating client stations operating with smart antennas and interfacing with an access point in accordance with the present invention.
Figure 2:
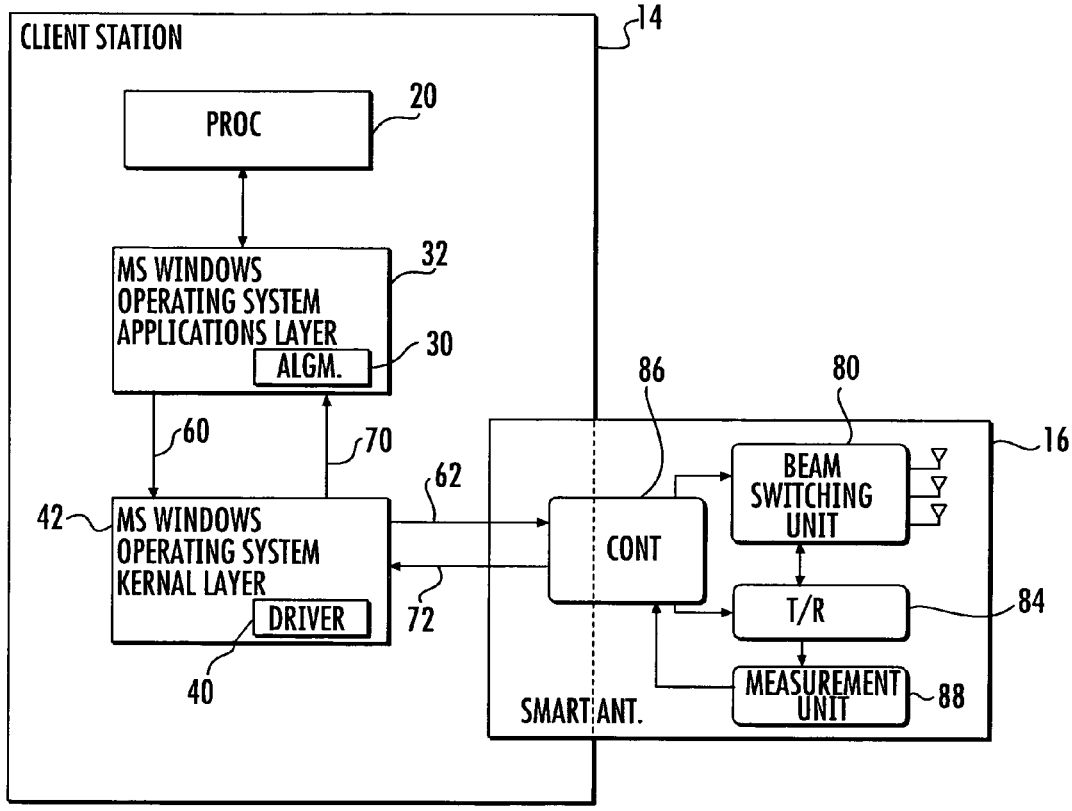
FIG. 2 is a more detailed block diagram of one of the client stations shown in FIG. 1 operating with a smart antenna.

Referring initially to FIGS. 1 and 2, an 802.11 wireless local area network (WLAN) 10 includes an access point 12, and client stations 14 operating with smart antennas 16 in accordance with the present invention. The illustrated client stations 14 are Microsoft Windows™ devices configured as laptop computers, and each includes a processor 20 operating a Microsoft Windows™ operating system that has a standardized set of object identifiers associated therewith. The illustrated smart antenna 16 is configured as a PCMCIA card, for example.

An antenna steering algorithm 30 is executed by the processor 20 based upon the standardized set of object identifiers instead of custom object identifiers. In other words, the metrics needed by the antenna steering algorithm 30 to determine how to operate the smart antenna 16 are provided using the predefined Microsoft addresses corresponding to the standardized set of WLAN OID_802_11 object identifiers. This avoids the manufacturer of a smart antenna and the corresponding driver from having to customize the addresses in the driver for newly defined object identifiers. As a result, the antenna steering algorithm 30 can be developed using the standardized set of WLAN OID_802_11 object identifiers.

The smart antenna 16 comprises a switched beam antenna 22, and generates a plurality of antenna beams in response to the antenna steering algorithm 30. The antenna beams generated by the smart antennas 16 include directional beams 24 and an omni-directional beam 26. The illustrated directional beam 24 for each client station 14 is a switched beam for communicating with the access point 12.

The smart antenna 16 interfaces with the antenna steering algorithm 30 via a driver 40. The Microsoft Windows™ operating system is broken up into an application layer 32 which is the layer where user applications reside, such as the antenna steering algorithm 30, and a kernel layer 42 which is a protected layer where device drivers typically reside, such as the driver 40 for the smart antenna 16.

Figure 3:
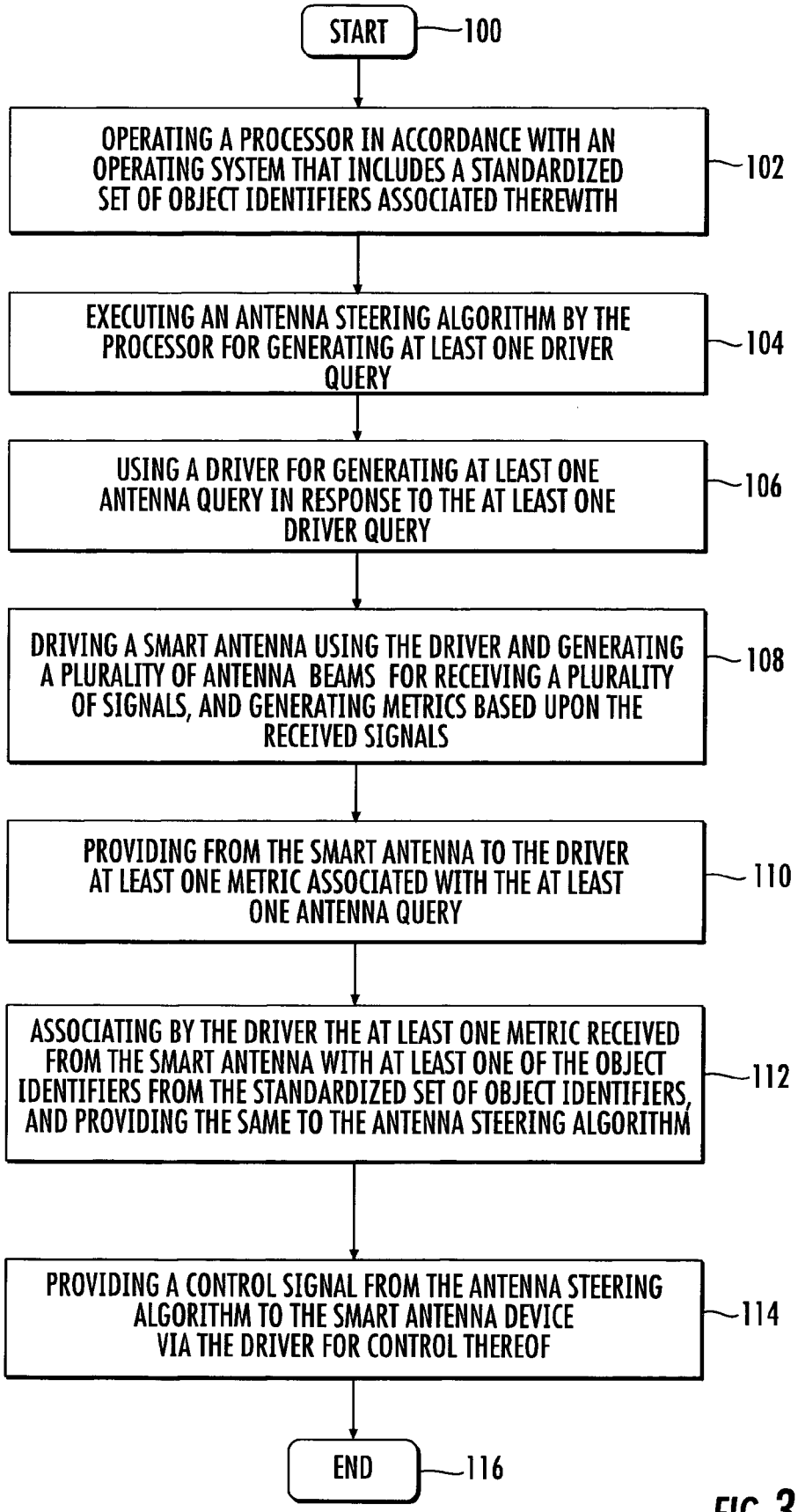
FIG. 3 is a flow diagram of a method for operating a client station and smart antenna in accordance with the present invention.

A method for operating a client station 16 in accordance with the present invention will now be discussed in reference to the flow diagram shown in FIG. 3. From the start (Block 100), the method comprises operating the client station 14 at Block 102, wherein the client station comprises a processor 20 that operates in accordance with an operating system that includes a standardized set of object identifiers associated therewith. The method further comprises executing at Block 104 an antenna steering algorithm 30 by the processor 20 for generating at least one driver query 60, and generating at Block 106 at least one antenna query 62 by a driver 40 in response to the at least one driver query.

The smart antenna 16 is driven by a driver 40 at Block 108 and generates a plurality of antenna beams 22, 24 for receiving a plurality of signals, and generates metrics based upon the received signals. The smart antenna 16 provides to the driver 40 at Block 110 at least one metric 72 associated with the at least one antenna query 62.

The driver 40 then associates at Block 112 the at least one metric 72 received from the smart antenna 16 with at least one of the object identifiers 70 from the standardized set of object identifiers, and provides the same to the antenna steering algorithm 30.

The antenna steering algorithm 30 provides a control signal at Block 114 from the antenna steering algorithm 30 to smart antenna 16 via the driver 40 at Block 114. The control signal is sent through the kernel layer 42, and does not have to be done through an object identifier. The method ends at Block 116.

The standardized set of object identifiers are part of a network device interface specification (NDIS) that resides between the network layer and the data link layer of the open systems interconnection (OSI) model, as readily appreciated by those skilled in the art. Microsoft's standardized set of object identifiers as related to wireless LANs is provided in TABLE 1.

TABLE 1

| | |
|---|---|
| OID_802_11_BSSID | OID_802_11_STATISTICS |
| OID_802_11_SSID | OID_802_11_DISASSOCIATE |
| OID_802_11_NETWORK_TYPES_SUPPORTED | DID_802_11_POWER_MODE |
| OID_802_11_NETWORK_TYPE_IN_USE | OID_802_11_BSSID_LIST_SCAN |
| OID_802_11_TX_POWER_LEVEL | OID_802_11_BSSID_LIST |
| OID_802_11_RSSI | OID_802_11_PRIVACY_FILTER |
| OID_802_11_RSSI_TRIGGER | OID_802_11_RELOAD_DEFAULTS |
| OID_802_11_INFRASTRUCTURE_MODE | OID_802_11_AUTHENTICATION_MODE |
| OID_802_11_FRAGMENTATION_THRESHOLD | OID_802_11_ENCRYPTION_STATUS |
| OID_802_11_RTS_THRESHOLD | OID_802_11_ADD_WEP |
| OID_802_11_NUMBER_OF_ANTENNAS | OID_802_11_REMOVE_WEP |
| OID_802_11_RX_ANTNNA_SELECTED | OID_802_11_ASSOCIATION_INFORMATION |
| OID_802_11_TX_ANTENNA_SELECTED | OID_802_11_TEST |
| OID_802_11_SUPPORTED_RATES | OID_802_11_CAPABILITY |
| OID_802_11_DESIRED_RATES | OID_802_11_PMKID |
| OID_802_11_CONFIGURATION | OID_802_11_MEDIA_STREAM_MODE |

As an example, the antenna steering algorithm 30 generates a driver query 60 to obtain a current value of the received signal strength (RSSI) from the directional antenna beams 24. The algorithm 30 uses the standard address associated with this object identifier, OID_802_11_RSSI. The driver 40 receives the driver query 60 for the OID_802_11_RSSI object identifier, and requests this information from the smart antenna 16.

If the device is associated, the smart antenna 16 returns the RSSI value to the driver 40 so that it can then be provided to the antenna steering algorithm 30. Based upon the returned RSSI value, the antenna steering algorithm 30 operates the smart antenna 16 accordingly.

As another example, the antenna steering algorithm 30 generates a driver query to obtain a current value of the statistics for the 802.11 interface between the client station 14 and the access point 12. There are 24 different statistics covered by the OID_802_11_STATISTICS object identifier. One of the statistics is ACKFailureCount, which is the number of times the smart antenna 16 expected an ACK that was not received. Another statistic is FCSErrorCount, which is the number of frames that the smart antenna 16 received that contained FCS errors.

The smart antenna 16 includes a beam switching unit 80 connected to a plurality of antenna elements 82, and a transceiver 84 is connected to the beam switching unit. The antenna elements 82 form an antenna array. The antenna array is not limited to any particular configuration. The antenna array may be configured to form a phased array or a switched beam antenna, for example.

A controller 86 is connected to the transceiver 84 and to the beam switching unit 80. A measurement unit 88 is connected to the transceiver 84 and to the controller 86 for measuring the signals received by the antenna elements 82.

The use of directional antenna beams 24 improves the throughput of the client station 14, and increases the communication range with the access point 12. A directional antenna beam 24 provides a high signal-to-noise ratio in most cases, thus allowing the link to operate at higher data rates. The PHY data rates for 802.11b links are 1, 2, 5.5, and 11 Mbps, and the rates for 802.11a are 6, 9, 12, 18, 24, 36, 48 and 54 Mbps. The 802.11g devices support the same data rates as 802.11a devices as well as the rates supported by 802.11b rates.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A communications device for operating in a wireless local area network (WLAN), and comprising:

a processor operating in accordance with an operating system that includes a standardized set of object identifiers associated therewith;

an antenna steering algorithm executed by said processor for generating at least one driver query;

a driver for generating at least one antenna query in response to the at least one driver query;

a smart antenna being driven by said driver and generating a plurality of antenna beams for receiving a plurality of signals, and generating metrics based upon the received signals, said smart antenna providing to said driver at least one metric associated with the at least one antenna query; and said driver associating the at least one metric received from said smart antenna with at least one of the object identifiers from the standardized set of object identifiers, and providing the same to the antenna steering algorithm.

2. The communications device according to claim 1 wherein the WLAN comprises an 802.11 WLAN.

3. The communications device according to claim 1 wherein the operating system comprises a Microsoft Windows™ operating system.

4. The communications device according to claim 1 wherein the standardized set of object identifiers comprises an OID_802_11_RSSI object identifier.

5. The communications device according to claim 1 wherein the standardized set of object identifiers comprises an OID_802_11_STATISTICS object identifier.

6. The communications device according to claim 5 wherein the OID_802_11_STATISTICS object identifier comprises statistics on at least one of ACKFailureCount and FCSErrorCount.

7. The communications device according to claim 1 wherein the plurality of antenna beams comprises a plurality of directional antenna beams.

8. The communications device according to claim 1 wherein said smart antenna comprises a plurality of antenna elements forming a phased array.

9. The communications device according to claim 1 wherein said smart antenna comprises a plurality of antenna elements comprising at least one active antenna element and at least one passive antenna element for forming a switched beam antenna.

10. The communications device according to claim 1 wherein said smart antenna is configured as a PCMCIA card.

11. A computer comprising:

a processor operating in accordance with a Microsoft Windows™ operating system that includes a standardized set of wireless local area network OID_802_11 object identifiers associated therewith;

an antenna steering algorithm executed by said processor for generating at least one driver query;

a driver for generating at least one antenna query in response to the at least one driver query;

a smart antenna being driven by said driver and generating a plurality of antenna beams for receiving a plurality of signals within a wireless local area network (WLAN), and generating metrics based upon the received signals, said smart antenna providing to said driver at least one metric associated with the at least one antenna query; and said driver associating the at least one metric received from said smart antenna with at least one of the OID_802_11 object identifiers from the standardized set of OID_802_11 object identifiers, and providing the same to the antenna steering algorithm.

12. The computer according to claim 11 wherein the WLAN comprises an 802.11 WLAN.

13. The computer according to claim 11 wherein the standardized set of object identifiers comprises an OID_802_11_RSSI object identifier.

14. The computer according to claim 11 wherein the standardized set of object identifiers comprises an OID_802_11_STATISTICS object identifier.

15. The computer according to claim 14 wherein the OID_802_11 STATISTICS object identifier comprises statistics on at least one of ACKFailureCount and FCSErrorCount.

16. The computer according to claim 11 wherein the plurality of antenna beams comprises a plurality of directional antenna beams.

17. The computer according to claim 11 wherein said smart antenna comprises a plurality of antenna elements forming a phased array.

18. The computer according to claim 11 wherein said smart antenna comprises a plurality of antenna elements comprising at least one active antenna element and at least one passive antenna element for forming a switched beam antenna.

19. A method for operating a communications device in a wireless local area network (WLAN) comprising a processor, an antenna steering algorithm, a driver and a smart antenna coupled to the driver, the method comprising:

operating the processor in accordance with an operating system that includes a standardized set of object identifiers associated therewith;

executing the antenna steering algorithm by the processor for generating at least one driver query for the driver;

generating at least one antenna query for the smart antenna in response to the at least one driver query;

driving the smart antenna by the driver and generating a plurality of antenna beams for receiving a plurality of signals, and generating metrics based upon the received signals, the smart antenna providing to the driver at least one metric associated with the at least one antenna query; and associating the at least one metric received by the driver from the smart antenna with at least one of the object identifiers from the standardized set of object identifiers, and providing the same to the antenna steering algorithm.

20. The method according to claim 19 wherein the WLAN comprises an 802.11 WLAN.

21. The method according to claim 19 wherein the operating system comprises a Microsoft Windows™ operating system.

22. The method according to claim 19 wherein the standardized set of object identifiers comprises an OID_802_11_RSSI object identifier.

23. The method according to claim 19 wherein the standardized set of object identifiers comprises an OID_802_11_STATISTICS object identifier.

24. The method according to claim 23 wherein the OID_802_11_STATISTICS object identifier comprises statistics on at least one of ACKFailureCount and FCSErrorCount.

25. The method according to claim 19 wherein the plurality of antenna beams comprises a plurality of directional antenna beams.

26. The method according to claim 19 wherein the smart antenna comprises a plurality of antenna elements forming a phased array.

27. The method according to claim 19 wherein the smart antenna comprises a plurality of antenna elements comprising at least one active antenna element and at least one passive antenna element for forming a switched beam antenna.

28. The method according to claim 19 wherein the smart antenna is configured as a PCMCIA card.

* * * * *